US012642414B2

(12) United States Patent
Dawson et al.

(10) Patent No.: US 12,642,414 B2
(45) Date of Patent: Jun. 2, 2026

(54) SURFACE CLEANER INCLUDING PUMP COOLING

(71) Applicant: TECHTRONIC CORDLESS GP, Anderson, SC (US)

(72) Inventors: Michael P. Dawson, Huntersville, NC (US); Rafael Davila, Kannapolis, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 414 days.

(21) Appl. No.: 18/556,784

(22) PCT Filed: Apr. 27, 2022

(86) PCT No.: PCT/US2022/026486
§ 371 (c)(1),
(2) Date: Oct. 23, 2023

(87) PCT Pub. No.: WO2022/232235
PCT Pub. Date: Nov. 3, 2022

(65) Prior Publication Data

US 2024/0206695 A1 Jun. 27, 2024

Related U.S. Application Data

(60) Provisional application No. 63/180,553, filed on Apr. 27, 2021.

(51) Int. Cl.
*A47L 11/40* (2006.01)

(52) U.S. Cl.
CPC ..... *A47L 11/4088* (2013.01); *A47L 11/4002* (2013.01); *A47L 11/4016* (2013.01); *A47L 11/4083* (2013.01)

(58) Field of Classification Search
CPC ..... A47L 7/0019; A47L 7/0023
See application file for complete search history.

(56) References Cited

U.S. PATENT DOCUMENTS 5,784,755 A 7/1998 Karr et al.
5,797,163 A 8/1998 Whitaker et al.
(Continued)

OTHER PUBLICATIONS

Australian Patent Office Action for Application No. 2022264506 dated Dec. 17, 2024 (4 pages).
(Continued)

*Primary Examiner* — Courtney D Heinle
*Assistant Examiner* — Danielle M. Christensen
(74) *Attorney, Agent, or Firm* — Michael Best & Friedrich LLP

(57) ABSTRACT

A surface cleaner (10) includes a housing (12) having a first tank guide projection (82) that is received in a first recess of a supply tank (14) when the supply tank is in a supply tank operating position and the first tank guide projection includes a cooling air inlet (85) in fluid communication with a cooling air inlet of a pump housing (72). The housing further includes a second tank guide projection (84) that is received in a second recess of the supply tank when the supply tank is in the supply tank operating position and the second tank guide projection forms a cooling air flow path between the cooling air inlet of the first tank guide and the cooling air inlet of the pump housing.

21 Claims, 8 Drawing Sheets

(56) References Cited

U.S. PATENT DOCUMENTS

| | | | | |
|---|---|---|---|---|
| 7,073,226 | B1 | 7/2006 | Lenkiewicz et al. | |
| 8,549,697 | B1 | 10/2013 | Moyher, Jr. et al. | |
| 10,327,616 | B2 | 6/2019 | Moyher, Jr. et al. | |
| 12,465,187 | B2 * | 11/2025 | Chan | A47L 11/4075 |
| 2006/0207052 | A1 | 9/2006 | Tran | |
| 2013/0318741 | A1 | 12/2013 | Moyher, Jr. et al. | |
| 2015/0245750 | A1 | 9/2015 | Wall et al. | |
| 2019/0274509 | A1 | 9/2019 | Moyher, Jr. et al. | |

OTHER PUBLICATIONS

International Search Report and Written Opinion for Applicatin No. PCT/US2022/026486 dated Jul. 20, 2022 (19 pages).

* cited by examiner

SURFACE CLEANER INCLUDING PUMP COOLING

CROSS-REFERENCE TO RELATED APPLICATIONS

This application claims priority to U.S. Provisional Patent Application No. 63/180,553, filed Apr. 27, 2021, the entire contents of which are hereby incorporated by reference herein.

BACKGROUND

The present disclosure relates to a surface cleaner and cooling a pump of the surface cleaner.

SUMMARY

In one embodiment a surface cleaner includes a housing, a suction nozzle coupled to the housing, and a recovery tank in fluid communication with the suction nozzle. The recovery tank is disposed on the housing in a recovery tank operating position. A suction source is disposed in the housing and the suction source us in fluid communication with the suction nozzle and the recovery tank. The suction source is configured to draw fluid and debris through the suction nozzle and into the recovery tank when the recovery tank is in the recovery tank operating position. A supply tank is configured to store a cleaning fluid and the supply tank is disposed on the housing in a supply tank operating position. A fluid distribution system includes a distributor in fluid communication with the supply tank when the supply tank is in the supply tank operating position and the distributor is configured to dispense the cleaning fluid from the supply tank onto a surface being cleaned. A pump is in fluid communication with the supply tank and the distributor and the pump is operable to pump the cleaning fluid in a direction from the supply tank to the distributor. A pump housing is disposed within the housing and the pump is disposed in the pump housing and the pump housing includes a cooling air inlet and a cooling air outlet in fluid communication with the suction source. The housing further includes a first tank guide that facilitates locating at least one of the recovery tank in the recovery tank operating position and the supply tank in the supply tank operating position. The first tank guide including a cooling air inlet in fluid communication with the cooling air inlet of the pump housing.

In another embodiment, a surface cleaner includes a housing, a suction nozzle coupled to the housing, and a recovery tank in fluid communication with the suction nozzle, the recovery tank is disposed on the housing in a recovery tank operating position. A suction source is disposed in the housing and the suction source is in fluid communication with the suction nozzle and the recovery tank. The suction source is configured to draw fluid and debris through the suction nozzle and into the recovery tank when the recovery tank is in the recovery tank operating position. A supply tank is configured to store a cleaning fluid and the supply tank includes a first recess and a second recess. The supply tank is disposed on the housing in a supply tank operating position. A fluid distribution system includes a distributor in fluid communication with the supply tank when the supply tank is in the supply tank operating position, the distributor is configured to dispense the cleaning fluid from the supply tank onto a surface being cleaned. A pump is in fluid communication with the supply tank and the distributor and the pump is operable to pump the cleaning fluid in a direction from the supply tank to the distributor. A pump housing is disposed within the housing, the pump is disposed in the pump housing and the pump housing includes a cooling air inlet and a cooling air outlet in fluid communication with the suction source. The housing further includes a first tank guide projection that is received in the first recess of the supply tank when the supply tank is in the supply tank operating position and the first tank guide projection includes a cooling air inlet in fluid communication with the cooling air inlet of the pump housing. The housing further includes a second tank guide projection that is received in the second recess of the supply tank when the supply tank is in the supply tank operating position and the second tank guide projection forms a cooling air flow path between the cooling air inlet of the first tank guide and the cooling air inlet of the pump housing.

In another embodiment, a surface cleaner includes a housing, a suction nozzle coupled to the housing, and a recovery tank in fluid communication with the suction nozzle. The recovery tank disposed on the housing in a recovery tank operating position. A suction source is disposed in the housing, the suction source is in fluid communication with the suction nozzle and the recovery tank, the suction source configured to draw fluid and debris through the suction nozzle and into the recovery tank when the recovery tank is in the recovery tank operating position. A supply tank is configured to store a cleaning fluid, the supply tank including a first recess and a second recess, the supply tank is disposed on the housing in a supply tank operating position. A fluid distributor is in fluid communication with the supply tank when the supply tank is in the supply tank operating position, the distributor configured to dispense the cleaning fluid from the supply tank onto a surface being cleaned. A pump is in fluid communication with the supply tank and the distributor, the pump is operable to pump the cleaning fluid in a direction from the supply tank to the distributor. A pump housing is disposed within the housing, the pump disposed in the pump housing and the pump housing including a cooling air inlet and a cooling air outlet in fluid communication with the suction source. The housing further includes a chamber having a first side and a second side opposite the first side, the chamber having a chamber floor at an elevation above the pump. The chamber further includes a chamber air inlet and a chamber air outlet in fluid communication with the cooling air inlet of the pump housing forming a cooling air path between the chamber air inlet and the pump housing.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
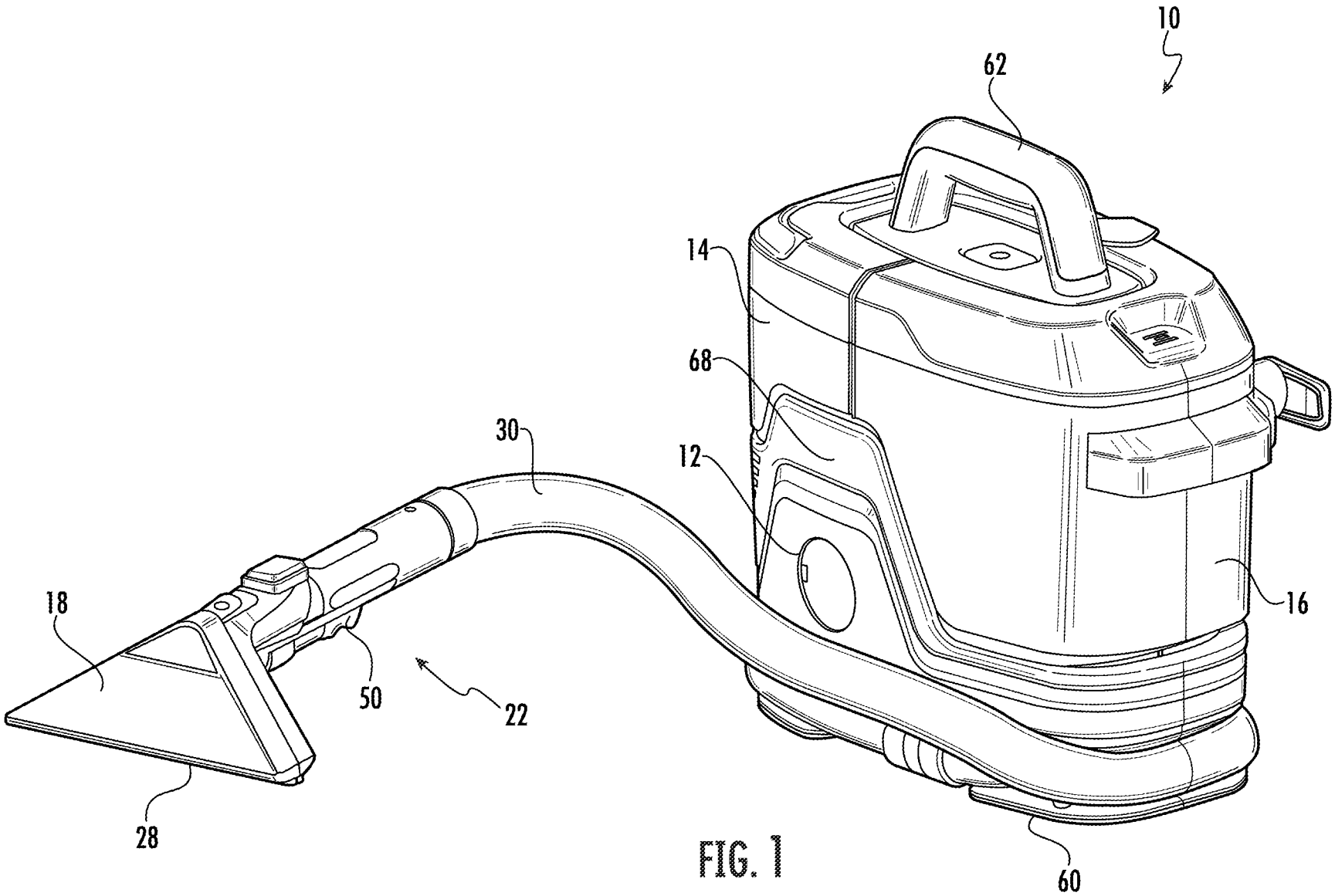
FIG. 1 is a perspective view of a surface cleaner according to one embodiment.

FIG. 1 illustrates a surface cleaner 10. The surface cleaner 10 includes a housing 12, a supply tank 14, and a recovery tank 16. The surface cleaner 10 further includes a suction nozzle 18 and a suction source 20 (FIG. 4) that are in fluid communication with the recovery tank 16. The surface cleaner 10 further includes a fluid distribution system 22 that includes a pump 24 (FIG. 4) and a distributor 26 (FIG. 8) that are in fluid communication with the supply tank 14 and operable to dispense fluid from the supply tank 14 onto a surface. As will be discussed in more detail below, the surface cleaner 10 includes features that facilitate cooling the pump 24 using an airflow generated by the suction source 20.

Figure 8:
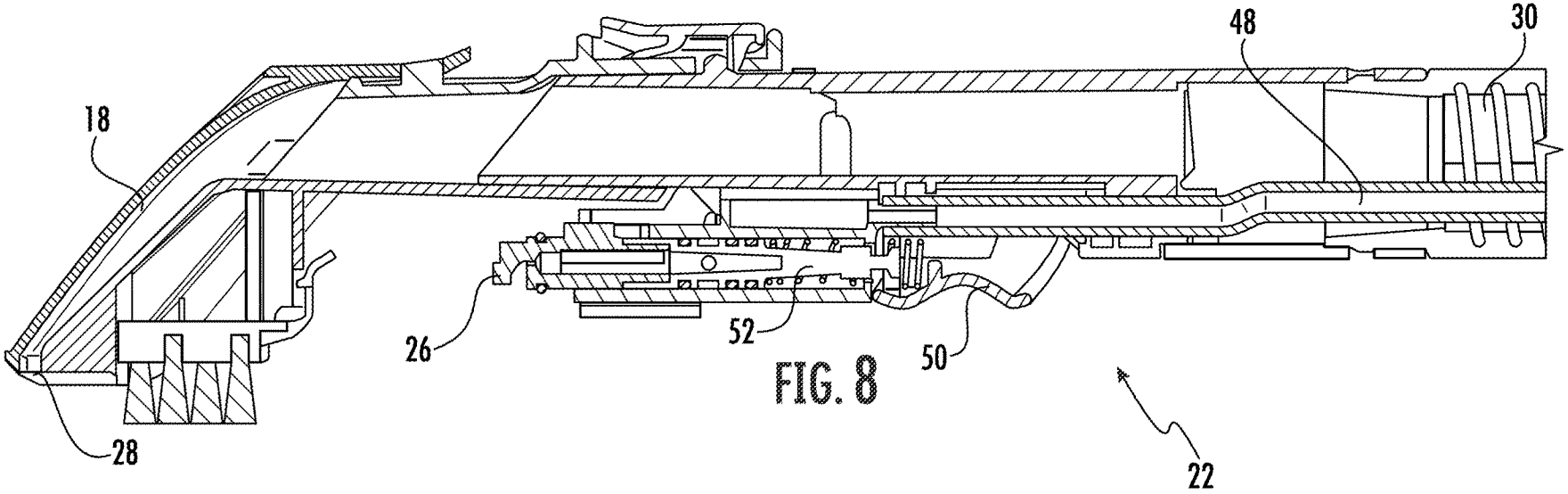
FIG. 8 is a cross-sectional view of a suction nozzle and hose of the surface cleaner of FIG. 1.

Referring to FIG. 8, in the illustrated embodiment, the suction nozzle 18 defines a suction inlet 28 of the surface cleaner 10. Air, debris, and fluid are drawn into the surface cleaner 10 through the suction inlet 28 by a suction airflow generated by the suction source 20. The illustrated cleaner 10 includes a hose 30. The hose 30 provides a flow path between the suction inlet 28 and housing 12 of the surface cleaner 10. In other embodiments, the surface cleaner 10 may include the suction inlet 28 mounted directly to the housing 12. Also, although the illustrated surface cleaner 10 is a spot cleaner or a portable cleaner, in other embodiments, the surface cleaner can be other types of surface cleaners, including an upright style floor cleaner.

Figure 2:
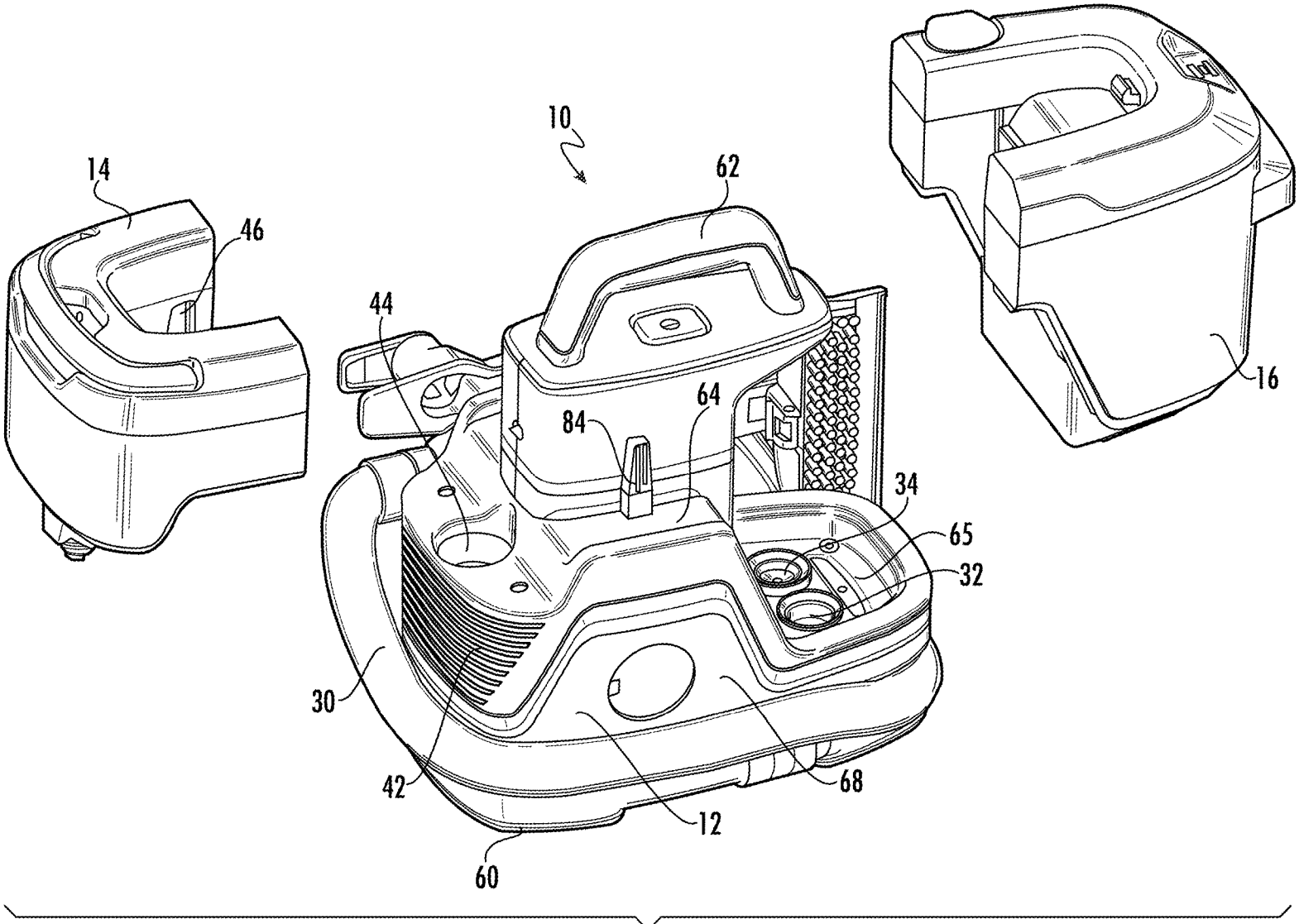
FIG. 2 is a perspective view of the surface cleaner of FIG. 1 with a supply tank and a recovery tank removed.

Referring to FIG. 2, the recovery tank 16 is in fluid communication with hose 30 and the suction nozzle 18 through a recovery tank inlet coupling 32. The suction airflow travels from the hose 30, through the coupling 32 and into the recovery tank 16 when the recovery tank 16 is in a recovery tank operating position shown in FIG. 1. Referring to FIG. 2, a recovery tank outlet coupling 34 is in fluid communication with the recovery tank 16. The suction airflow travels from the recover tank 16, through the coupling 34, into the housing 12 and toward the suction source 20. Recovered fluid and debris are retained in the recovery tank 16. The recovery tank 16 can be removed or uncoupled from the housing 12 (FIG. 2) to facilitate emptying the recovery tank 16. In the illustrated embodiment, the recovery tank 16 is shaped such that the recovery tank 16 wraps around the housing 12.

Figure 4:
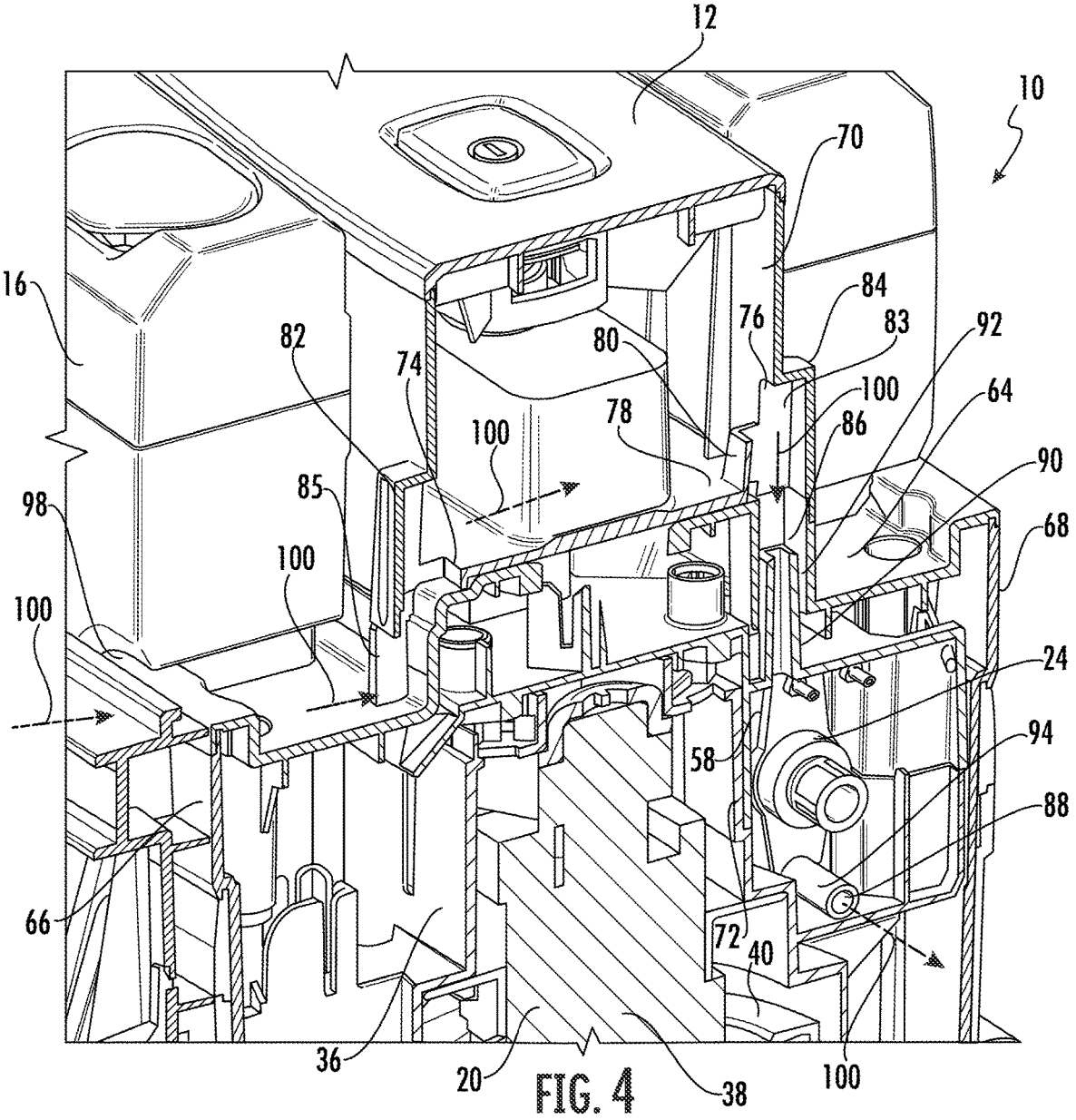
FIG. 4 is a cross-sectional view of the surface cleaner taken along line 4-4 of FIG. 3
Figure 5:
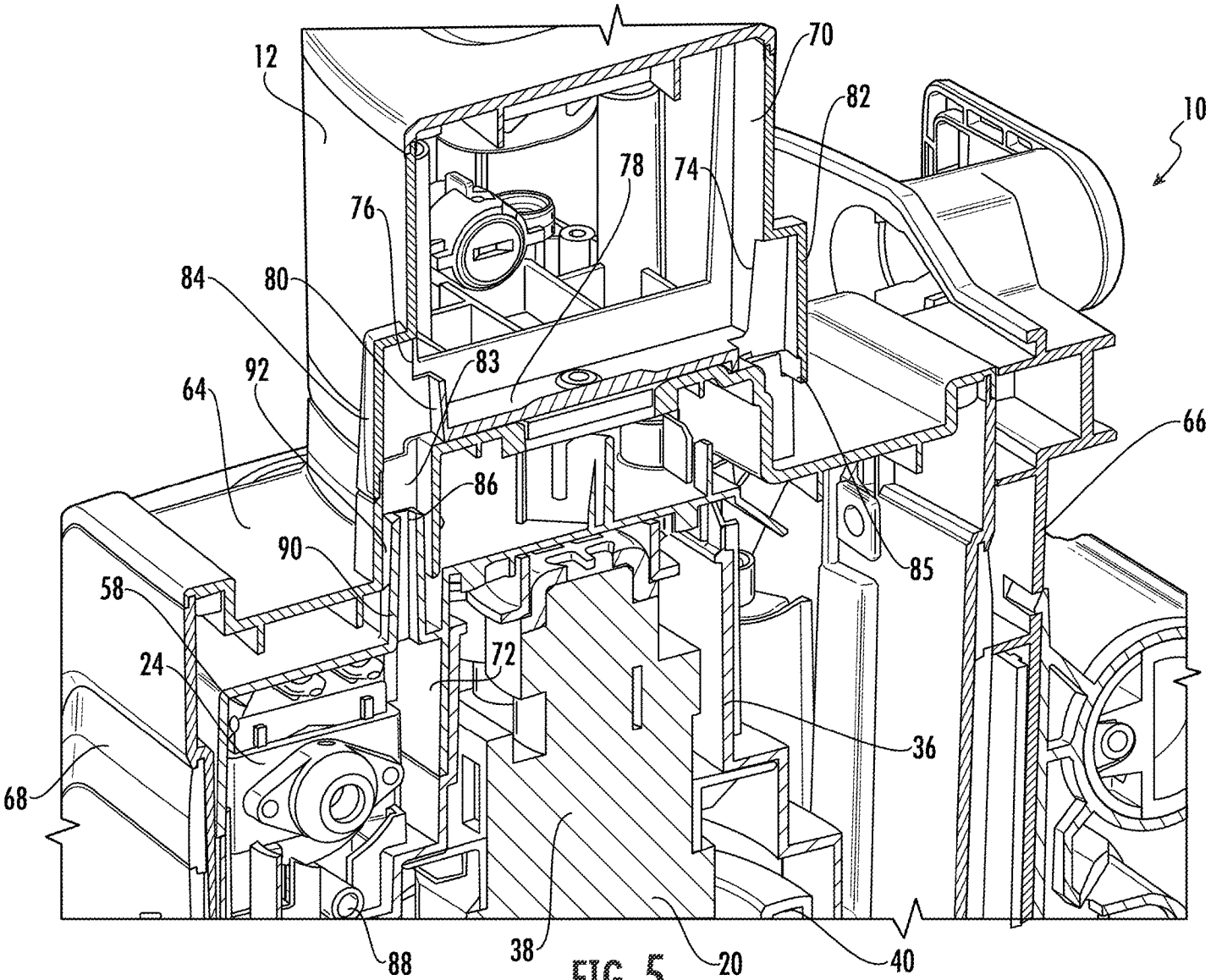
FIG. 5 is a cross-sectional view of the surface cleaner taken along line 5-5 of FIG. 3.

Referring to FIG. 4, the suction source 18 is disposed within the housing 12. In the illustrated embodiment, the housing 12 includes a suction source housing 36 within the housing 12 and the suction source 20 is within the housing 36. The suction source housing 36 inhibits water from contacting the suction source 18. The suction source 18 include a motor 38 and a fan 40 that are operable to generate the suction airflow. The suction source 18 is in fluid communication with the suction nozzle 18 and the recovery tank 16 and is operable to draw fluid and debris through the suction nozzle 18 into the recovery tank 16 when the recovery tank 16 is the operating position shown in FIG. 1. The suction airflow is exhausted from the surface cleaner through an exhaust outlet 42 (FIG. 2) located in the housing 12.

Figure 3:
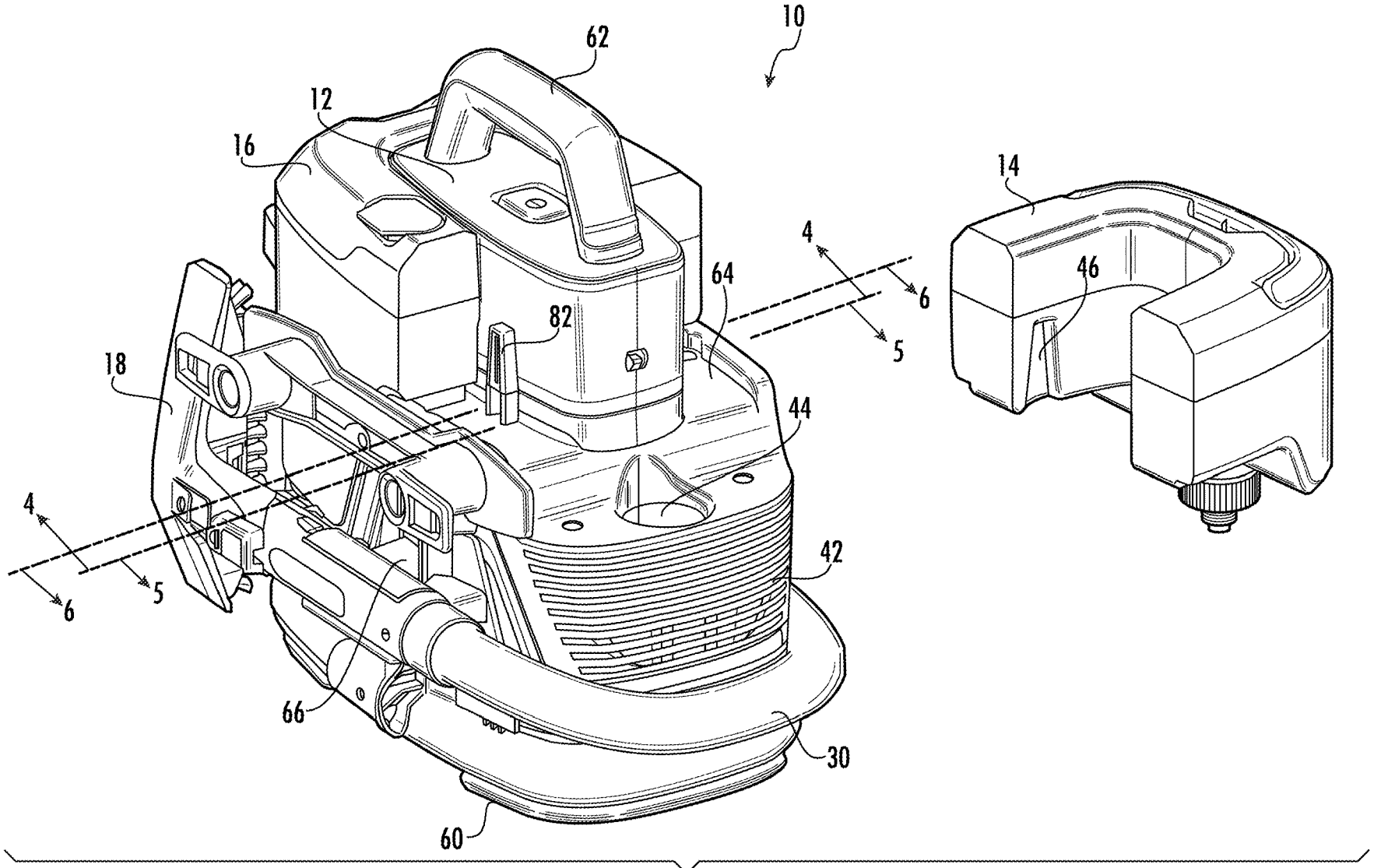
FIG. 3 is a perspective view of the surface cleaner of FIG. 1 with the supply tank removed.

Referring to FIGS. 2 and 3, the supply tank 14 stores a cleaning fluid. The cleaning fluid may include water or a mixture of water and a cleaning agent. The supply tank 14 is in fluid communication with the fluid distribution system 22 to supply the cleaning fluid to the fluid distribution system through a supply tank outlet coupling 44 when the supply tank 14 is in a supply tank operating position (FIG. 1). In the supply tank operating position, the supply tank 14 is disposed on the housing 12. In the illustrated embodiment, the supply tank 14 is shaped such that the supply tank 14 wraps around the housing 12 and together the supply tank 14 and the recovery tank 16 wrap completely (about 360 degrees) around the housing 12. The supply tank 14 includes first and second guide recesses 46 on the inside of the supply tank 14. The second guide recess 46 is opposite the first guide recess 46. The guide recesses 46 facilitate coupling or attaching the supply tank 14 to the housing 12, which will be discussed in more detail below. The supply tank 14 is uncoupled from the housing 12 to facilitate filling and/or emptying the supply tank 14.

Figure 6:
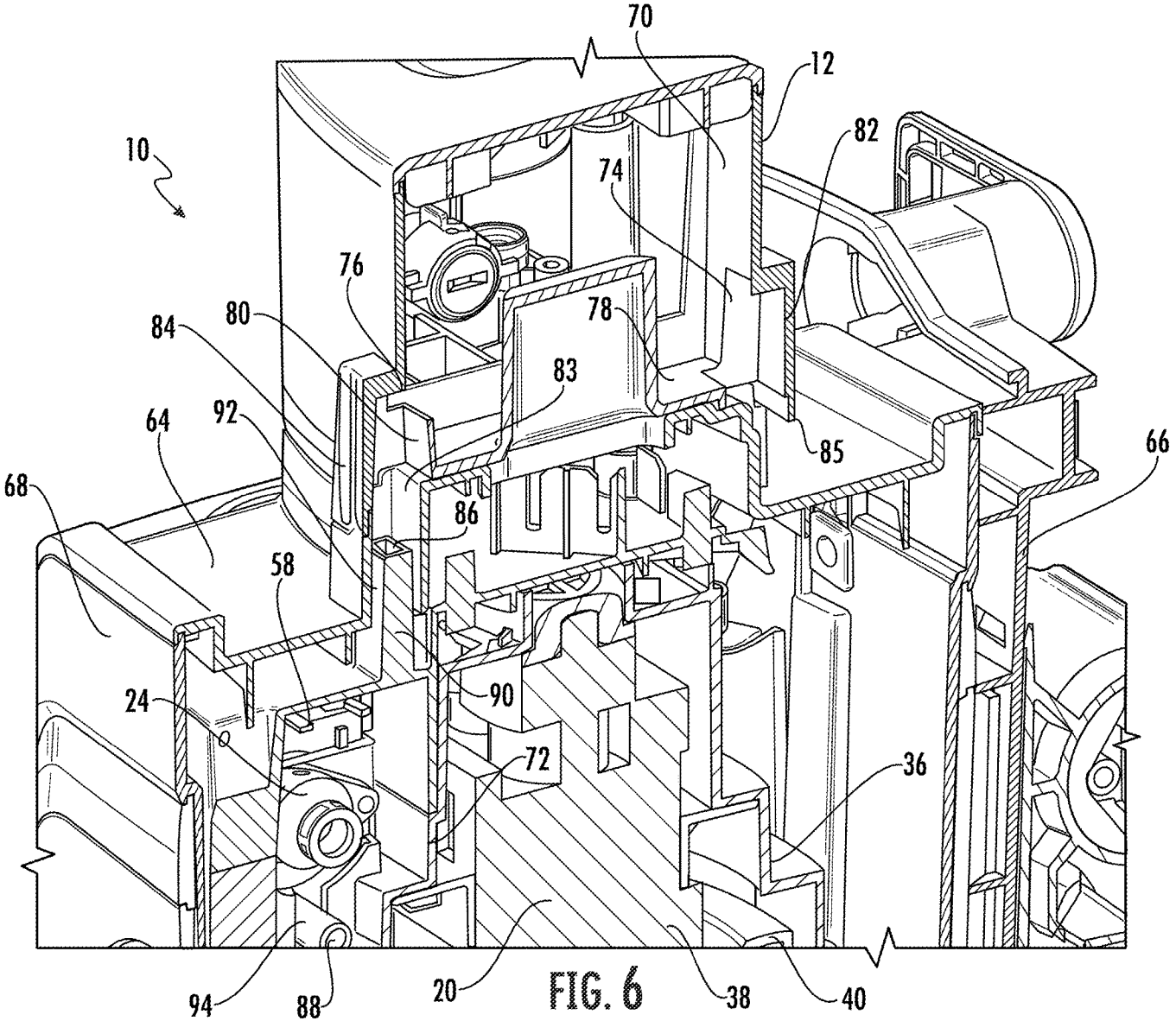
FIG. 6 is a cross-sectional view of the surface cleaner taken along line 6-6 of FIG. 3.

Referring to FIGS. 1, 6, and 8, the fluid distribution system 22 includes the pump 24 and the distributor 26. The distributor 26 is a spray nozzle in the illustrated embodiment that is adjacent the suction inlet 28. The distributor 26 is in fluid communication with the supply tank 14 through a supply hose 48 that is located within the suction hose 30. An actuator 50 controls a valve 52, which together control the flow of cleaning fluid through the distributor 26 and onto the surface being cleaned. The pump 24 is in fluid communication with the supply tank 14 and the distributor 26 through the supply hose 48. The pump 24 is operable to pump or pressurize the cleaning fluid from the supply tank 14 through the hose 48 and the distributor 26. In the illustrated embodiment, the pump 24 is powered by a solenoid 58, but could be powered by a motor 58 or other drive.

Referring to FIG. 2, the housing 12 includes a base 60. The base 60 supports the surface cleaner 10 on a surface (e.g., floor). The housing 12 further includes a handle 62 opposite the base 60 and the handle 62 extends from a top of the housing 12. A tank tray extends around the perimeter of the housing 12 and the tank tray includes a supply tank tray 64 and a recovery tank try 65. In the illustrated embodiment, the supply tank tray 64 and the recovery tank tray 65 extend around the entire perimeter (i.e., about 360 degrees). In one embodiment, the supply tank tray 64 and the recovery tank tray 65 are separated. The recovery tank tray 65 supports the recovery tank 16 and the supply tank tray 64 supports the supply tank 14 that rest or set on top of the tank trays 64, 65.

Referring to FIG. 4, the housing 12 further includes a first side 66 and a second side 68 opposite the first side 66. The housing 12 includes an upper chamber 70 between the first side 66 and the second side 68 and adjacent the handle 62. The upper chamber 70 is disposed directly above the suction source housing 36 and below the handle 62 in the illustrated embodiment. The housing 12 includes a pump housing 72 that is adjacent the second side 68 in the illustrated embodiment. The pump housing 72 houses or encloses the pump 24 and the solenoid or pump motor 58. The pump housing 72 provide an additional source of protection for the pump 24 and the solenoid or pump motor 58 to inhibit water or other liquids from contacting the pump assembly.

The upper chamber 70 includes an air inlet 74, an air outlet 76, and a floor 78. A wall 80 is adjacent the air outlet 76 and the wall 80 extends up from the floor 78 around the air outlet 76. The wall 80 positions the air outlet 76 at an elevation relative to the ground or floor above the air inlet 76. Also, the floor 78 is contiguous with the air inlet 74. The configuration of the air inlet 74, the air outlet 76, the floor 78, and the wall 80 inhibits any liquid that may enter the chamber 70 from traveling through the outlet 76. Also, any liquid that may enter the chamber 70 is directed back toward the air inlet 74 to exit the chamber 70 through the air inlet 74 and onto the tank tray 64.

The housing 12 further includes a first tank guide 82 on the first side 66 of the housing 12 and a second tank guide 84 on the second side 68 of the housing 12. The first and second tank guides 82, 84 facilitate locating the supply tank 14 in the supply tank operating position and assist the user in attaching the supply tank 14 to the housing 12. In other embodiments, the tank guides 82, 84 can be used facilitate locating the recovery tank 16. In the illustrated embodiment, the tank guides 82, 84 are projections that extend from their respective side 66, 68 of the housing 12. The tank guides 82, 84 are received in the guide recesses 46 of the supply tank 14 when the supply tank 14 is in the operating position. Also, the tank guides 82, 84 are between the supply tank 14 and the housing 12 so that the tank guides 82, 84 are generally hidden from view when the supply tank 14 is in the supply tank operating position. In the illustrated embodiment, the tank guides 82, 84 are generally hollow and provide a cooling air flow path for the pump housing 72 as will be described below.

The first tank guide 82 includes a cooling air inlet 85 in fluid communication with the air inlet 74 of the upper chamber 70. Also, the cooling air inlet 85 is adjacent the tank tray 64. The second tank guide 84 is adjacent the air outlet 76 of the upper chamber 70 and directly adjacent the air outlet 76 in the illustrated embodiment. In another embodiment, the cooling air inlet 85 is an inlet through the wall of the housing 12 in communication with or forming the chamber air inlet 74 and not associated with the first tank guide.

A cooling air flow passageway 83 in communication with the chamber air outlet 76 extends between the upper chamber 70 and the pump housing 72 providing a cooling air flow path between the upper chamber 70 and the pump housing 72. In one embodiment, the cooling air flow passageway 83 extends downwardly. In the illustrated embodiment, the second tank guide 84 forms the cooling air passageway 83 providing the cooling air flow path between the chamber air outlet 76 and the pump housing 72.

Figure 7:
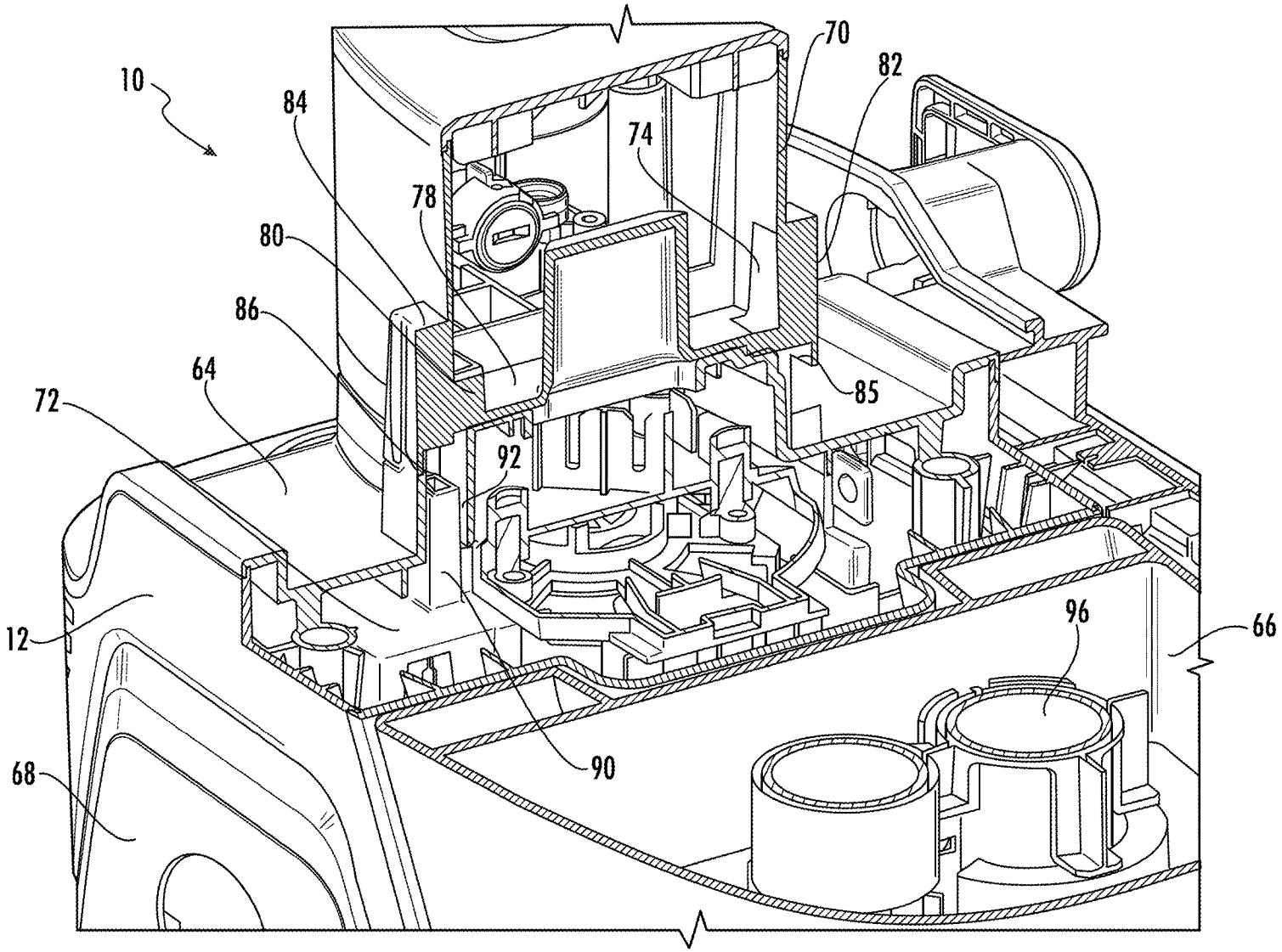
FIG. 7 is a quarter cross-sectional view of the surface cleaner taken along line 6-6 of FIG. 3.

The pump housing 72 includes a cooling air inlet 86 and a cooling air outlet 88. The cooling air inlet 86 of the pump housing 72 is configured to inhibit liquid entering the housing 12 from traveling through the cooling air inlet 86. In the illustrated embodiment, the cooling air inlet 86 of the pump housing 72 is disposed on a projection 90 that extends upwardly and into the second tank guide 84. The projection 90 includes the cooling air inlet 86 and positions the cooling air inlet 86 in fluid communication with the cooling air flow passageway 83. The projection 90 has an outer dimension that is less than the inner dimensions of the tank guide 84 such that there is a gap 92 around the perimeter of the projection 90 between the projection 90 and the second tank guide 84. The gap 92 provides an additional route for any liquid to travel or drain from the housing 12 to inhibit the liquid from entering the pump housing 72. In other embodiments, the cooling air inlet 86 may be laterally offset or misaligned with the flow path created by the cooling air flow passageway 83 or the second tank guide 84. The cooling air outlet 88 of the pump housing 72 is formed by a cooling air duct 94. The cooling air duct 94 is a tube in the illustrated embodiment that extends from the pump housing 72 to a location in a suction airflow path between the recovery tank 16 and the suction source 20. For example, referring to FIG. 7, the cooling air duct 94 is attached to a duct 96. The suction airflow from the suction source 20 travels through the duct 96 from the recovery tank 16 before traveling through the suction source 20.

In operation, the user sprays the cleaning fluid from the supply tank 14 onto a surface to be cleaned by pressing the actuator 50. The pump 24 pressurizes the cleaning fluid to facilitate spraying the cleaning fluid through the distributor 26 onto the surface. The suction source 20 generates a suction airflow, which is used to draw the liquid and debris through the suction inlet 28 and into the hose 30. The airflow, debris and liquid, travel through the hose 30 and into the recovery tank 16. The liquid and debris are separated from the airflow and are retained in the recovery tank 16 while the airflow is exhausted through the exhaust outlet 42. Referring to FIG. 4, meanwhile, a cooling airflow (represented by arrows 100) is also generated by the suction source 20 and is used to cool the pump 24 and the solenoid or pump motor 58. The cooling airflow 100 passes through a gap 98 between the tanks 14, 16 and the tank tray 64. The cooling airflow 100 then travels through the cooling air inlet 85 of the first tank guide 82, through the first tank guide 82 and into the upper chamber 70. The airflow exits the upper chamber 70 through the outlet 76 and travels into the pump housing 72 through the cooling air inlet 86 of the pump housing 72. The airflow 100 passes over the pump assembly to cool the pump 24 and the solenoid or pump motor 58. The airflow 100 exist the pump housing 72 through the duct 94 and the airflow 100 travels to the suction source 20 and is eventually exhausted through the exhaust outlet 42.

Various features and advantages of the invention are set forth in the following claims.

What is claimed is:

1. A surface cleaner comprising:

a housing;

a suction nozzle coupled to the housing;

a recovery tank in fluid communication with the suction nozzle, the recovery tank disposed on the housing in a recovery tank operating position;

a suction source disposed in the housing, the suction source in fluid communication with the suction nozzle and the recovery tank, the suction source configured to draw fluid and debris through the suction nozzle and into the recovery tank when the recovery tank is in the recovery tank operating position;

a supply tank configured to store a cleaning fluid, the supply tank disposed on the housing in a supply tank operating position;

a distributor in fluid communication with the supply tank when the supply tank is in the supply tank operating position, the distributor configured to dispense the cleaning fluid from the supply tank onto a surface being cleaned;

a pump in fluid communication with the supply tank and the distributor, the pump operable to pump the cleaning fluid in a direction from the supply tank to the distributor; and a pump housing disposed within the housing, the pump disposed in the pump housing and the pump housing including a cooling air inlet and a cooling air outlet in fluid communication with the suction source, such that air is configured to enter the pump housing through the cooling air inlet, pass over the pump to cool the pump, and then exit the pump housing through the cooling air outlet, and wherein the housing further includes a first tank guide that facilitates locating at least one of the recovery tank in the recovery tank operating position and the supply tank in the supply tank operating position, the first tank guide including a cooling air inlet in fluid communication with the cooling air inlet of the pump housing.

2. The surface cleaner of claim 1, wherein in the housing further includes a second tank guide that facilitates locating one of the recovery tank in the recovery tank operating position and the supply tank in the supply tank operating position.

3. The surface cleaner of claim 2, wherein the second tank guide forms a cooling air flow path between the cooling air inlet of the first tank guide and the cooling air inlet of the pump housing.

4. The surface cleaner according to claim 3, wherein the first tank guide facilitates locating the supply tank in the supply tank operating position and the second tank guide facilitates locating the supply tank in the supply tank operating position.

5. The surface cleaner according to claim 4, wherein the first tank guide includes a projection that extends outward from the housing, wherein the projection is received in a first recess of the supply tank when the supply tank is in the supply tank operating position, wherein the second tank guide includes a projection that extends outwardly from the housing, wherein the projection of the second tank guide is received in a second recess of the supply tank when the supply tank is in the supply tank operating position.

6. The surface cleaner according to claim 3, wherein the cooling air inlet of the pump housing is located within the second tank guide.

7. The surface cleaner of claim 6, wherein the pump housing includes an inlet projection that includes the cooling air inlet of the pump housing, wherein the inlet projection extends into the second tank guide.

8. The surface cleaner according to claim 3, wherein the first tank guide is between the supply tank and the housing when the supply tank is in the supply tank operating position.

9. The surface cleaner according to claim 3, wherein the cooling air flow path extends through the housing.

10. The surface cleaner according to claim 3, wherein the housing includes a first side and a second side opposite the first side, wherein the first tank guide is disposed on the first side of the housing and the second tank guide is disposed on the second side of the housing.

11. The surface cleaner according to claim 1, wherein the first tank guide includes a projection that extends outwardly from the housing, wherein the projection is received in a recess of one of the recovery tank in the recovery tank operating position and the supply tank in the supply tank operating position.

12. The surface cleaner according to claim 1, wherein the housing includes a supply tank tray and a recovery tank tray, wherein the supply tank tray supports the supply tank and the recovery tank tray supports the recovery tank in the supply tank operating position and the recovery tank operating position.

13. The surface cleaner of claim 12, wherein the cooling air inlet is adjacent at least one of the supply tank tray and the recovery tank tray.

14. The surface cleaner according to claim 1, further comprising a cooling air duct that extends from the pump housing to a location in a suction airflow path between the recovery tank and the suction source.

15. The surface cleaner according to claim 1, further comprising a hose, wherein the suction nozzle is coupled to the housing by the hose and the hose is in fluid communication with the recovery tank.

16. The surface cleaner according to claim 1, wherein the first tank guide facilitates locating the supply tank in the supply tank operating position.

17. A surface cleaner comprising:

a housing;

a suction nozzle coupled to the housing;

a recovery tank in fluid communication with the suction nozzle, the recovery tank disposed on the housing in a recovery tank operating position;

a suction source disposed in the housing, the suction source in fluid communication with the suction nozzle and the recovery tank, the suction source configured to draw fluid and debris through the suction nozzle and into the recovery tank when the recovery tank is in the recovery tank operating position;

a supply tank configured to store a cleaning fluid, the supply tank including a first recess and a second recess, the supply tank disposed on the housing in a supply tank operating position;

a distributor in fluid communication with the supply tank when the supply tank is in the supply tank operating position, the distributor configured to dispense the cleaning fluid from the supply tank onto a surface being cleaned;

a pump in fluid communication with the supply tank and the distributor, the pump operable to pump the cleaning fluid in a direction from the supply tank to the distributor; and a pump housing disposed within the housing, the pump disposed in the pump housing and the pump housing including a cooling air inlet and a cooling air outlet in fluid communication with the suction source, such that air is configured to enter the pump housing through the cooling air inlet, pass over the pump to cool the pump, and then exit the pump housing through the cooling air outlet, and wherein the housing further includes a first tank guide projection that is received in the first recess of the supply tank when the supply tank is in the supply tank operating position, the first tank guide projection including a cooling air inlet in fluid communication with the cooling air inlet of the pump housing, and wherein the housing further includes a second tank guide projection that is received in the second recess of the supply tank when the supply tank is in the supply tank operating position, the second tank guide projection forms a cooling air flow path between the cooling air inlet of the first tank guide and the cooling air inlet of the pump housing.

18. The surface cleaner of claim 17, wherein the cooling air inlet of the pump housing is located within the second tank guide.

19. The surface cleaner of claim 18, wherein the pump housing includes an inlet projection that includes the cooling air inlet of the pump housing, wherein the inlet projection extends into the second tank guide.

20. The surface cleaner according to claim 17, wherein the cooling air flow path extends through the housing.

21. The surface cleaner according to claim 17, wherein the housing includes a first side and a second side opposite the first side, wherein the first tank guide projection is disposed on the first side of the housing and the second tank guide projection is disposed on the second side of the housing.

* * * * *